United States Patent [19]

Nassof

[11] 4,439,973

[45] Apr. 3, 1984

[54] CLIP FOR METAL PLANKS

[75] Inventor: Martin Nassof, Cliffside Park, N.J.

[73] Assignee: Simplex Ceiling Corp., Hoboken, N.J.

[21] Appl. No.: 282,064

[22] Filed: Jul. 10, 1981

[51] Int. Cl.[3] ..... F04B 1/38; F04B 5/52

[52] U.S. Cl. ..... 52/714; 52/489; 52/665; 52/718

[58] Field of Search ..... 52/710, 712, 714, 508, 52/489, 718, 717, 716, 762, 665; 24/243 E, 255 E, 331

[56] References Cited

U.S. PATENT DOCUMENTS

| | | | |
|---|---|---|---|
| 1,897,776 | 2/1933 | Venzie | 52/466 |
| 2,129,976 | 9/1938 | Urbain et al. | 52/489 |
| 2,585,996 | 2/1952 | Brown | 52/718 |
| 2,681,715 | 6/1954 | Hansen | 52/714 |
| 3,313,075 | 4/1967 | Buchmeier | 52/489 |
| 3,319,983 | 5/1967 | Zibell | 52/489 |
| 3,620,027 | 11/1971 | Nordell | 52/762 |

FOREIGN PATENT DOCUMENTS

| | | | |
|---|---|---|---|
| 2467927 | 5/1981 | France | 52/714 |

*Primary Examiner*—Alfred C. Perham
*Attorney, Agent, or Firm*—Jacobs & Jacobs

[57] ABSTRACT

A clip for attachment of metal planking to a T-bar, which comprises an elongated main body having parallel sides, a generally trapezoidal projecting portion, and an intermediate portion integral with and joining the longer base of said trapezoidal portion to a side of said main body portion, all of said portions being coplanar and the bases of said trapezoidal portion being parallel to said main body sides, said intermediate portion being shorter than said longer base to define a pair of opposed open slots between said projecting portion and said main body portion for receiving the edges of the metal plank; and an elongated ear normal to and integral with said trapezoidal portion at each inclined side thereof and extending from the longer base to the shorter base thereof, each said ear being operable, when one edge of a plank is secured in a slot and the free edge of the plank is manually pushed against said ear, to cam the free edge of a plank across said ear and into said slot.

4 Claims, 6 Drawing Figures

FIG. 3
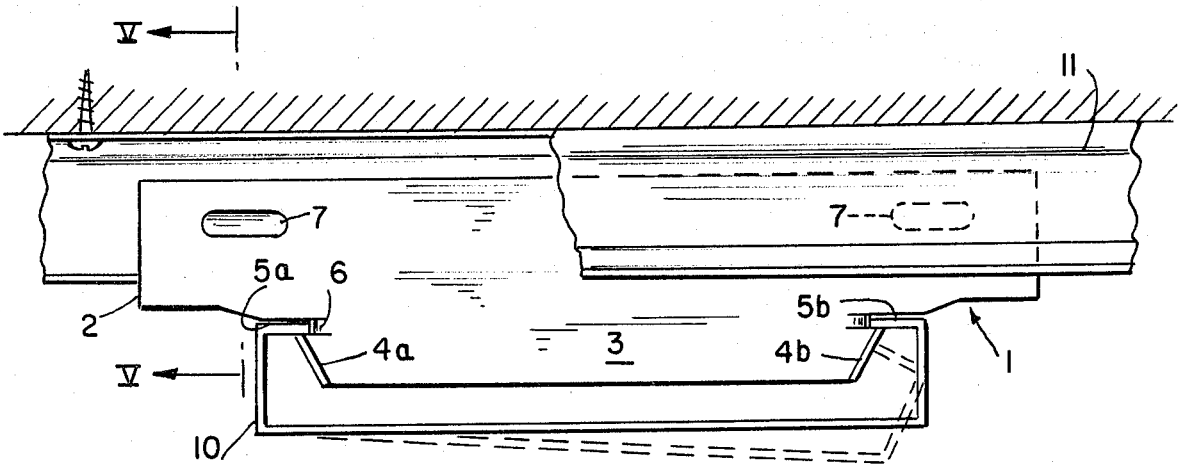
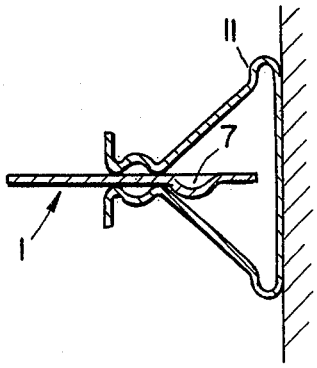
FIG. 5
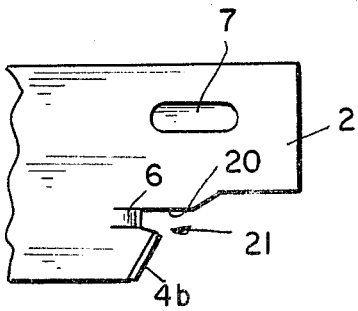
FIG. 6

CLIP FOR METAL PLANKS

A system of decorating walls and ceilings has been introduced using metal planks, usually of aluminum. The planks are secured via clips to T-bars attached to the wall, but the present clips for securing the planks to the T-bars are not totally satisfactory. First, the present clips do not permit rapid attachment of the planks. Rather, the planks must be bent and rotated into place. Also, the present method of installing the clips allows excessive play of the planks in the clips, which gives rise to excessive noise and vibration in wind or moving air.

The present invention now provides an improved clip, which comprises an elongated main body having parallel sides, a generally trapezoidal projecting portion, and an intermediate portion integral with and joining the longer base of said trapezoidal portion to a side of said main body portion, all of said portions being coplanar and the bases of said trapezoidal portion being parallel to said main body sides, said intermediate portion being shorter than said longer base to define a pair of opposed open slots between said projecting portion and said main body portion for receiving the edges of a metal plank; and an elongated ear normal to and integral with said trapezoidal portion at each inclined side thereof and extending from the longer base to the shorter base thereof, each said ear being operable, when one edge of a plank is secured in a slot and the free edge of the plank is manually pushed against said ear, to cam the free edge of a plank across said ear and into said slot.

In a preferred embodiment, the intermediate portion has opposed, integral movable tab means at each end thereof, said tabs being bent away from the plane of said coplanar portions and operable to be manually bent towards or away from said plane to shorten or lengthen, respectively, its associate slot.

The present invention is illustrated in the accompanying drawing, in which:

FIG. 3 is a top plan view, partly in section, of a clip installed in a T-bar with a plank attached to the clip;

FIG. 5 is a view, in section, along line V—V of FIG. 3; and

FIG. 6 is a detailed view of another embodiment of the invention.

Figure 1:
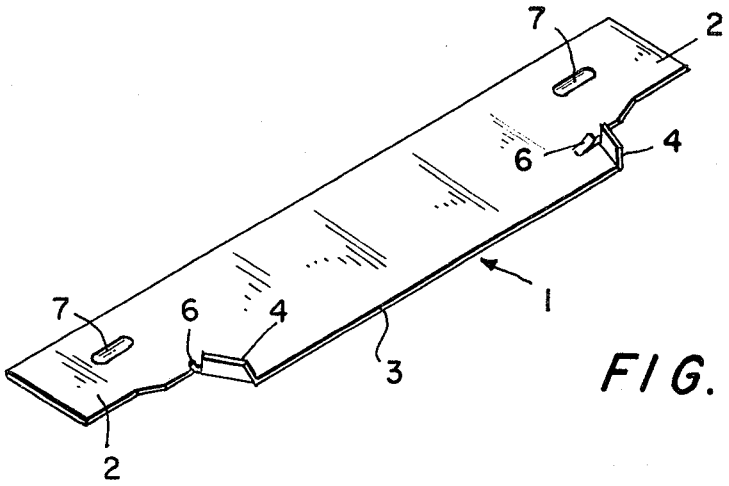
FIG. 1 is a view, in perspective, of the clip according to the invention.

Referring to FIG. 1, the clip 1 of the invention has opposed ends 2 and an intermediate portion 3 terminating in raised ears 4*a*,4*b*. Between 4*a*,4*b* and the edge of end portion 2 are slots 5*a*,5*b*, which are more clearly seen in FIG. 3 and which serve to hold the metal plank 10 in place in a manner to be described in detail hereinafter.

Figure 2:
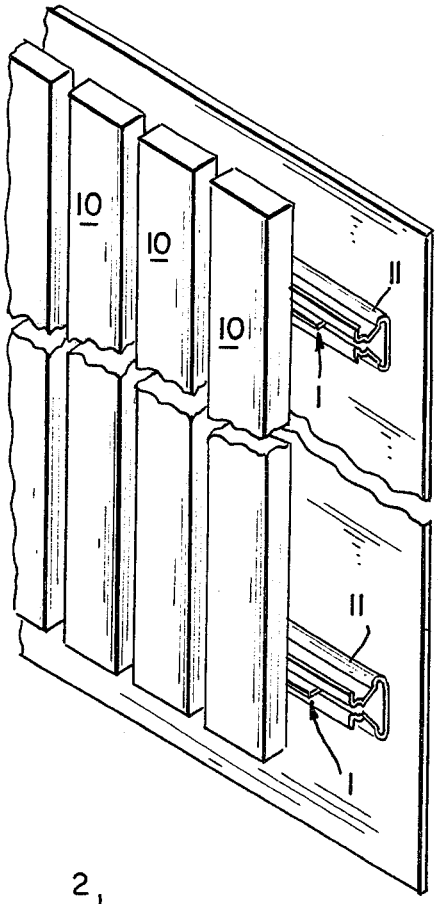
FIG. 2 is a view, in perspective, of a wall having planks mounted thereon using the clip of the invention.

FIG. 2 shows a wall in the process of being decorated with metal planks 10. The planks 10 are installed as follows. First, a plurality of T-bars 11 are attached to the wall, one below the other. Two T-bars 11 are shown for simplicity, but normally they are spaced two feet apart. After the T-bars 11 are attached to the wall, a plurality of rows clips 1 are snapped into each T-bar, there being one vertical row of clips 1 for each plank to be used.

FIG. 3 shows a typical clip 1 in a T-bar 11. The clip 1 is prevented from accidentally coming out of the T-bar 11 by the dimples 7 (FIG. 1).

After the clips 1 are installed in the T-bars 11, the first plank is snapped onto the uppermost clip 1 in the first row of clips. First, an edge 10*a* of the plank 10 is fitted into slot 5*a* of the clip 1 with the other edge 10*b* resting on the surface of the ear 4*b*. This position of plank 10 is shown in dotted line in FIG. 3. When the center of plank 10 is smartly struck by the heel of the hand, the end 10*b* rides across the inclined surface of ear 4*b* and snaps into slot 5*b*. Plank 10 then assumes the position shown in full line in FIG. 3. This process is repeated for all of the clips 1 below the uppermost clip, until the plank is seated on each clip in the row. The next plank is then installed on the next row of clips, and the installed planks are slid together so that ends 2 of adjacent clips butt together.

Ears 4*a*,4*b* thus provide a smooth, inclined cam surface that spreads the opposed ends 10*a*,10*b* of the plank 10 apart and causes the edge 10*b* to move along the surface of ear 5*b* and thence snap into seat 5*b*. While ears 4*a*,4*b* are shown to be on the same side of clip 1, they can be on opposite sides as well. The ears 4*a*,4*b* should have a significant height and length to present a smooth spreading and snapping action.

FIG. 6 shows a modification of the clip 1, in which slot 20 has a wider mouth 21 than slots 5*a*,5*b*, so that slot 20 converges inwardly. The slightly wider mouth 21 will facilitate entry of the end 5*b* of plank 10 into slot 20. Mouth 21 cannot be made too wide or else the plank 10 will wobble in slot 20.

Figure 4:
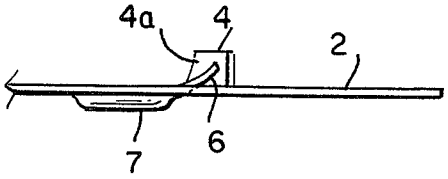
FIG. 4 is a rear elevational view of the clip of the invention.

Variations in the width of the planks 10 occur during manufacture, and this causes the planks to be loose and vibrate with wind or air motion. To eliminate the excess play, the clip 1 is provided with tabs 6 at the end of slots 5*a* and 5*b*. The tabs 6 rise above the surface of the clip 1 (FIGS. 4 and 5) and can be bent down to touch the plank 10 to insure a snug fit of the plank 10 in clip 1. If need be, the tabs 6 can also be bent upwardly if the mouth of the plank is too narrow. In any case, the slots 5*a*,5*b* of each clip 1 can be adjusted to the perfect depth to eliminate play of the planks in the clips. Preferably, the tabs 6 are on the same side of clip 1 to simplify manufacture and use.

I claim:

1. A clip for attachment of metal planking to a T-bar, which comprises an elongated main body having parallel sides, a generally trapezoidal projecting portion, and an intermediate portion integral with and joining the longer base of said trapezoidal portion to a side of said main body portion, all of said portions being coplanar and the bases of said trapezoidal portion being parallel to said main body sides, said intermediate portion being shorter than said longer base to define a pair of opposed open slots between said projecting portion and said main body portion for receiving the edges of a metal plank; said intermediate portion having opposed, integral movable tab means at each end thereof, said tabs being bent away from the plane of said coplanar portions and operable to be manually bent towards or away from said plane to shorten or lengthen, respectively, its associated slot; and an elongated ear normal to and integral with said trapezoidal portion at each inclined side thereof and extending from the longer base to the shorter base thereof, each said ear being operable, when one edge of a plank is secured in a slot and the free edge of the plank is manually pushed against said ear, to cam the free edge of a plank across said ear and into said slot.

2. The clip according to claim 1, wherein said ears project from the same face of said coplanar portions.

3. The clips according to claim 1, wherein said tabs are bent away from the same face of said coplanar portions.

4. The clip according to claim 1, wherein said slot converges inwardly from the mouth thereof.

* * * * *